US008408128B2

(12) United States Patent
Balleis et al.

(10) Patent No.: US 8,408,128 B2
(45) Date of Patent: Apr. 2, 2013

(54) METHOD FOR OPERATING A CLEANING APPARATUS OF A PRINTING PRESS AND PRINTING PRESS FOR CARRYING OUT THE METHOD

(75) Inventors: Stephan Balleis, Heidelberg (DE); Rainer Hofmann, Hirschhorn (DE); Patrick Roth, Kandel (DE); Bernd Sitzmann, Sandhausen (DE); Markus Uihlein, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 537 days.

(21) Appl. No.: 12/553,132

(22) Filed: Sep. 3, 2009

(65) Prior Publication Data

US 2010/0050892 A1 Mar. 4, 2010

(30) Foreign Application Priority Data

Sep. 3, 2008 (DE) ..... 10 2008 045 659

(51) Int. Cl.
*B41F 35/00* (2006.01)

(52) U.S. Cl. ..... 101/425; 101/424

(58) Field of Classification Search ..... 101/425
See application file for complete search history.

(56) References Cited

U.S. PATENT DOCUMENTS

| | | | | |
|---|---|---|---|---|
| 3,658,003 | A * | 4/1972 | Johnson | 101/483 |
| 4,774,884 | A * | 10/1988 | Sugimoto et al. | 101/170 |
| 5,067,193 | A * | 11/1991 | Thomas | 15/88.3 |
| 5,181,470 | A | 1/1993 | Barrois et al. | |
| 5,253,495 | A * | 10/1993 | Zimmer | 68/43 |
| 5,636,571 | A * | 6/1997 | Abrahamson | 101/424 |
| 6,029,575 | A | 2/2000 | Bischer | |
| 6,254,688 | B1 * | 7/2001 | Kobayashi et al. | 134/1 |
| 7,047,881 | B2 * | 5/2006 | Schaede | 101/424 |
| 7,125,456 | B2 | 10/2006 | Leufgens | |
| 7,771,540 | B2 * | 8/2010 | Schwartz | 134/1 |

FOREIGN PATENT DOCUMENTS

| | | | |
|---|---|---|---|
| DE | 2952489 | A1 | 8/1980 |
| DE | 3025639 | A1 | 1/1982 |
| DE | 4438043 | A1 | 5/1996 |
| DE | 10213647 | B4 | 10/2003 |
| EP | 0520305 | A1 | 12/1992 |
| EP | 0919381 | A1 | 6/1999 |
| GB | 2063765 | A | 6/1981 |

OTHER PUBLICATIONS

German Search Report dated Mar. 25, 2009.

* cited by examiner

*Primary Examiner* — Anthony Nguyen
(74) *Attorney, Agent, or Firm* — Laurence A. Greenberg; Werner H. Stemer; Ralph E. Locher

(57) ABSTRACT

A method for operating a cleaning apparatus, having a trough and a brush disposed in the trough, in a printing press, includes first, second and third steps. In the first step, a cylinder of the printing press is cleaned by the cleaning apparatus, with the brush bearing against the cylinder. In the second step, the brush is moved away from the cylinder, and a level of a liquid in the trough is changed, resulting in the liquid being brought into contact with the brush. In the third step, the brush is cleaned by the liquid in the trough. A printing press for carrying out the method is also provided.

10 Claims, 1 Drawing Sheet

METHOD FOR OPERATING A CLEANING APPARATUS OF A PRINTING PRESS AND PRINTING PRESS FOR CARRYING OUT THE METHOD

CROSS-REFERENCE TO RELATED APPLICATION

This application claims the priority, under 35 U.S.C. §119, of German Patent Application DE 10 2008 045 659.4, filed Sep. 3, 2008; the prior application is herewith incorporated by reference in its entirety.

BACKGROUND OF THE INVENTION

Field of the Invention

The present invention relates to a method for operating a cleaning apparatus of a printing press and a printing press for carrying out the method.

The invention was produced against the following background: printing press cylinders, for example printing form cylinders, blanket cylinders or impression cylinders, are cleaned by cleaning apparatuses. The cleaning apparatuses often include a brush roller. A brush roller of that type is contaminated during the cylinder cleaning and therefore has to be cleaned itself from time to time. The brush roller can be cleaned outside or inside the printing press.

German Patent DE 102 13 647 B4, corresponding to U.S. Pat. No. 7,125,456, describes cleaning of the brush roller which takes place outside the printing press. In that case, the cleaning apparatus is removed together with the brush roller from the printing press and is placed into a cleaning trough. The cleaning trough is equipped with ultrasonic generators which act on the cleaning liquid, in order to boost its action. The great amount of time which the removal of the cleaning apparatus from the printing press requires is unfavorable.

European Patent EP 0 919 381 B1, corresponding to U.S. Pat. No. 6,029,575, describes cleaning of the brush roller which takes place inside the printing press. In that case, the brush roller is rotated inside a housing which is closed beforehand. As a result of the rotations, contaminants are centrifuged out of a brush border of the brush roller, which is assisted by scrapers that reach into the brush border. Although that method makes rapid cleaning of the brush roller possible, it does not make thorough cleaning of the brush roller possible.

European Patent Application EP 0 520 305 A1, corresponding to U.S. Pat. No. 5,181,470, is also not capable of making a contribution to solving this problem. That document describes a cleaning apparatus which has a rubber covered roller that is brought into contact with a so-called distributor cylinder of an inking unit, in order to clean the distributor cylinder. A so-called polygonal roller which dips into a trough disposed below it bears against the rubber covered roll. The trough is filled with a cleaning agent and is equipped with an ultrasonic generator which serves to remove ink residues that remain on the polygonal roller.

SUMMARY OF THE INVENTION

It is accordingly an object of the invention to provide a method for operating a cleaning apparatus of a printing press and a printing press for carrying out the method, which overcome the hereinafore-mentioned disadvantages of the heretofore-known methods and devices of this general type and by way of which rapid and nevertheless thorough cleaning of a brush of a cleaning apparatus can be achieved.

With the foregoing and other objects in view there is provided, in accordance with the invention, a method for operating a cleaning apparatus of a printing press. The method comprises providing a cylinder of the printing press and providing the cleaning apparatus with a trough and a brush disposed in the trough. In a first step, the cylinder of the printing press is cleaned with the cleaning apparatus while the brush bears against the cylinder. In a second step, the brush is moved away from the cylinder and a level of a liquid in the trough is changed relative to the brush, resulting in the liquid being brought into contact with the brush. In a third step, the brush is cleaned with the liquid in the trough.

In the method according to the invention, a cleaning apparatus of a printing press is operated according to a plurality of method steps. The cleaning apparatus includes a brush and a trough, in which the brush is disposed. The brush can be a brush bar which cannot rotate. The method according to the invention includes a first step, in which a cylinder of the printing press is cleaned by the cleaning apparatus, with the brush being set against the cylinder. The cylinder can be a printing form cylinder for printing or varnishing the printing material. The cylinder can likewise be a blanket cylinder for printing or varnishing the printing material. The cylinder can also be, for example, an impression cylinder for transporting sheet-shaped printing material, for example. Finally, the cylinder can also be a tool cylinder, for example a stamping or punching cylinder, for processing the printing material in a manner which deforms or severs the printing material. The cylinder is preferably a cylinder which is not an inking unit roll or a dampening unit roll. In a second step of the method according to the invention, the brush is set away from the cylinder, and the level of a liquid in the trough is changed relative to the brush and the liquid is brought into contact with the brush as a result of this change. For example, the level of the liquid relative to the brush can be changed, by the trough being pivoted or tilted with the liquid situated in it. In this case, no supply of the liquid into the trough is required to change the level relative to the brush.

The liquid volume situated in the trough is distributed differently as a consequence of the tilting, with the result that it then reaches the brush. The liquid can be a washing solution or flushing water. The movement of the brush and the changing of the level can take place at the same time or preferably one after another. For example, first of all the movement of the brush can take place, and afterward the changing of the level. The changing of the level can advantageously take place very rapidly, with the result that maintenance time can be saved in comparison with the explained method of the prior art, in which time consuming removal of the cleaning apparatus from the printing press is required. The method according to the invention is therefore particularly advantageous with regard to machine operation with frequent ink or varnish changes which in each case require intermediate cleaning of the cylinder and the brush and with frequent job changes. The method according to the invention includes a third step, in which the brush is cleaned through the use of the liquid in the trough. If the brush is mounted rotatably, the cleaning of the brush can be assisted by a stripper reaching into the brush border of the brush during the cleaning of the brush which rotates in the process.

The method according to the invention is particularly well suited for cleaning apparatuses of printing presses which print emulsion inks or emulsion varnishes. Those inks and varnishes are deposited particularly tenaciously in the brush border of the brush and can only be detached from it with difficulty. Tests have shown that, if the method according to the invention is used, thorough removal of dried emulsion ink or varnish residues is possible without problems, even after a drying time of several days.

In accordance with another feature of the invention, the brush and the trough are moved away from the cylinder together in the second step. The brush and the trough can be constituent parts of one structural unit which is mounted in such a way that it can be set against and away from the cylinder.

In accordance with a further feature of the invention, the liquid level in the trough is raised in the second step, by conveying the liquid into the trough. In this case, before the liquid level is raised, the trough can still be completely empty or can already be filled partially with the liquid. The liquid can be filled into the trough from above and in the process, for example, first reach the brush and then run off from the latter into the trough.

In accordance with an added feature of the invention, the trough is closed by a cover after the first step. The cover can be closed in the second step or in the third step, and it can take place before or after the liquid level is raised, and it takes place in any case after the brush is moved away from the cylinder. The cover can be closed automatically through the use of an actuating drive or manually by the operator.

In accordance with an additional feature of the invention, the brush is a rotatable brush roller. During the cleaning of the cylinder which takes place in the first step, the brush roller can rotate in the same direction as or in the opposite direction to the cylinder, with the brush roller having a circumferential speed in the case of rotation in the same direction, which differs from that of the cylinder.

In accordance with yet another feature of the invention, when the brush roller is cleaned in the third step, the brush roller is rotated discontinuously and/or at a lower speed than when the cylinder is cleaned in the first step. As a result, intensive contact is achieved between the liquid in the trough and the brush roller along its entire circumference.

In accordance with yet a further feature of the invention, energy is transferred to the liquid in the third step through the use of an ultrasonic generator of the cleaning apparatus, in order to clean the brush.

In accordance with yet an added feature of the invention, the trough is moved away from the cylinder in the second step. The brush and the trough can be moved away from the cylinder in the second step together or one after another.

In accordance with yet an additional feature of the invention, the level of the liquid in the trough relative to the brush is changed in the second step, by the level being raised. The level of the liquid can be raised, for example, by a body which displaces the liquid being dipped into the liquid in the trough.

With the objects of the invention in view, there is concomitantly provided a printing press which is configured for carrying out the method according to the invention or which corresponds to one of the developments of the invention.

Other features which are considered as characteristic for the invention are set forth in the appended claims.

Although the invention is illustrated and described herein as embodied in a method for operating a cleaning apparatus of a printing press and a printing press for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figures 1, 2, 3:
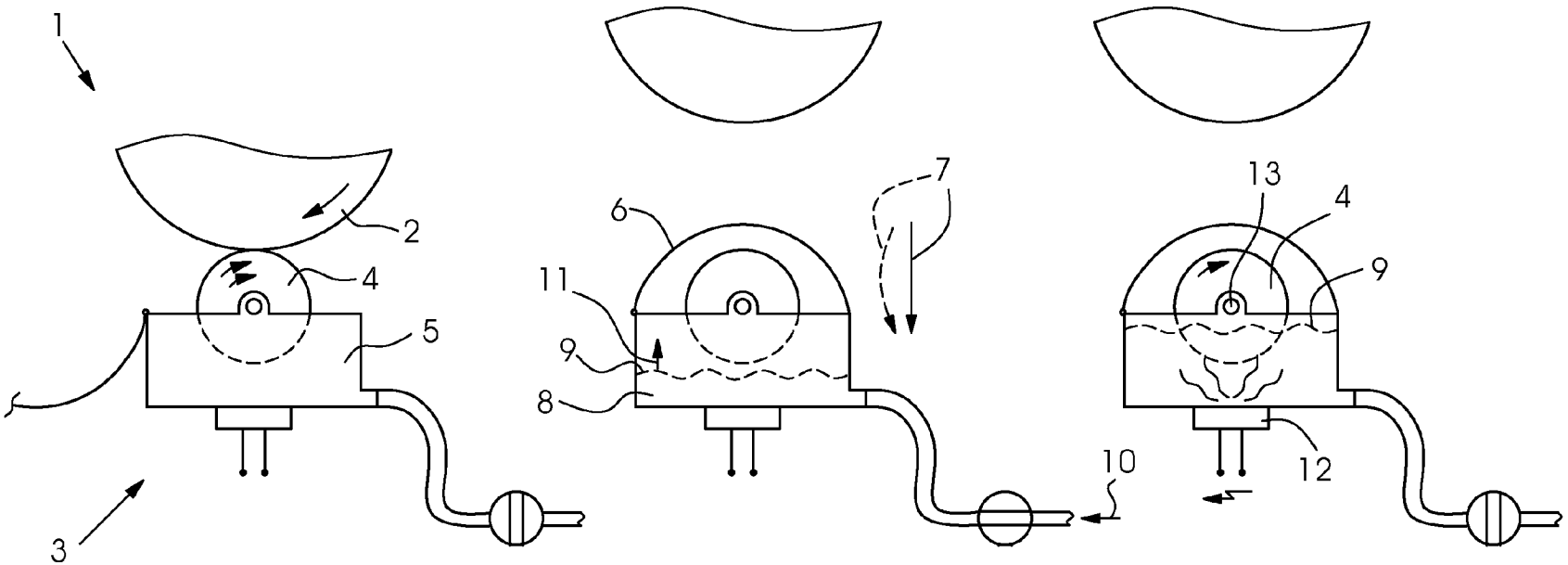
FIG. 1 is a fragmentary, diagrammatic, side-elevational view of a cleaning apparatus in an operating situation designated as "cylinder cleaning", in which a brush roller of the cleaning apparatus bears against a cylinder during the cleaning of the latter.
FIG. 2 is a side-elevational view of the cleaning apparatus of FIG. 1 in an operating situation designated as "brush cleaning preparation", in which the brush roller is set away from the cylinder and a liquid level in a trough of the cleaning apparatus is raised.
FIG. 3 is a side-elevational view of the cleaning apparatus of FIGS. 1 and 2 in an operating situation designated as "brush cleaning execution", in which the liquid in the trough is acted on by an ultrasonic generator, in order to clean the brush roller.

Referring now to the figures of the drawings in detail and first, particularly, to FIG. 1 thereof, there is seen a portion of a printing press 1. The printing press 1 is a lithographic offset printing press for printing sheets. The fragmentary illustration shows constituent parts of a varnishing unit of the printing press 1. The varnishing unit includes a cylinder 2 which carries a rubber blanket for full surface area varnishings or a flexographic printing form for spot varnishings. The cylinder 2 is coordinated with a cleaning apparatus 3. During the cleaning of the cylinder 2, a brush roller 4 of the cleaning apparatus 3 bears against the cylinder 2, or more precisely against the rubber blanket or the flexographic printing form. The brush roller 4 dips partially into a trough 5, together with which the brush roller 4 forms a structural unit which can be moved to and from the cylinder 2.

FIG. 2 shows that a cover 6 of the trough 5 has been closed, in order to cover an opening of the trough 5 which points toward the cylinder 2 and a part of the brush roller 4 which protrudes out of the trough 5. The cleaning apparatus 3 is mounted in a guide 7 and is guided by the latter during an adjustment or movement of the cleaning apparatus 3 which takes place relative to the cylinder 2. The guide 7 can be a linear guide, as is indicated by a rectilinear arrow symbol with a continuous line, and can alternatively be a pivot bearing, as is indicated by an arcuate arrow symbol with an interrupted line.

The brush roller 4 is brought out of contact with the cylinder 2 by a respective throwing off movement, independently of whether the cleaning apparatus 3 is displaced or pivoted away from the cylinder 2 through the use of the guide 7. After the trough 5 has been moved together with the brush roller 4 away from the cylinder 2, the cover 6 is closed, in order to encapsulate the brush roller 4 between the trough 5 and the cover 6. Afterward, the trough 5 is flooded with a liquid 8 which serves to clean the brush roller 4. The liquid 8 can already have been heated before it is filled into the trough 5. The liquid 8 is conveyed into the trough 5 through the use of a feed device 10, for example a pump, which is symbolized by an arrow. In this case, a filling state or level 9 of the liquid 8 rises in the trough 5 over time, until the level 9 reaches the brush roller 4 and the latter dips into the liquid to a sufficient extent. The rise of the level 9 is shown in FIG. 2 by way of an arrow 11. The liquid volume which is filled into the trough 5 is dimensioned in such a way, however, that the lower half of the brush roller 4 dips only partially into the liquid and a pivot bearing 13 of the brush roller 4 is also situated above the level 9 when the trough 5 is filled. As a result, corrosion and contamination of the pivot bearing 13 are avoided.

FIG. 3 shows a state in which the brush roller 4 has already dipped deeply enough into the liquid 8 in the trough 5, in order to be cleaned. During this cleaning of the brush roller 4, an ultrasonic generator 12, for example a so-called ultrasonic transducer or a so-called ultrasonic oscillator, which is attached to the trough 5, is activated. The ultrasonic generator 12 can be disposed on an outer side of a wall, for example a base, of the trough 5 or can be integrated into the wall as a so-called plate oscillator. It is also conceivable to use a so-called immersible transducer which is suspended into the liquid. The oscillations of the ultrasonic generator 12 are transmitted through the wall to the liquid 8, in which an ultrasonic field is produced, from which waves with positive pressure and vacuum result.

As a consequence of the oscillations which are generated by the ultrasonic generator 12, an intensive interaction occurs between the brushes of the brush roller 4 and the liquid 8. As a consequence of the intensive interaction even varnish residues which have dried onto the brushes in a very firm manner are detached completely from the bristles. It is to be assumed that steam bubbles are formed by the vacuum waves in the liquid 8. The steam bubbles collapse as a result of the following excess pressure waves, with a so-called cavitation effect contributing to a pronounced extent to the satisfactory cleaning action.

As a result of the rotation of the brush roller 4 during the cleaning, all of the circumferential sections of the brush roller 4 come into contact one after another with the liquid 8 and come into an active region of the waves which are generated by the ultrasonic generator 12. In this case, the brush roller 4 rotates more slowly than in the operating situation shown in FIG. 1, which is indicated by a number of arrows that symbolize the rotation of the brush roller 4 and is reduced from FIG. 1 to FIG. 2.

Even if several days have passed between the use of the brush roller 4 for cleaning the cylinder 2 (see FIG. 1) and the following cleaning of the brush roller 4 (see FIG. 3) and the brush roller 4 is therefore stuck to the varnish to a very pronounced extent, complete freeing of the brush roller 4 from the contaminants is ensured by the cleaning of the brush roller 4 which takes place with the aid of the ultrasonic generator 12.

After the brush roller 4 has been cleaned, the contaminated liquid 8 is let or pumped out of the trough 8. Afterward, flushing water is sprayed onto the brush roller 4 or is injected into its brush border through the use of a spraying device (not shown in the drawing) which is integrated into the cleaning apparatus 3. The flushing water and, with it, the remaining contaminants, are centrifuged from the brush roller 4 by subsequent rotation of the brush roller 4 at a high speed which is much higher than the speed during rotation of the brush roller 4 in the liquid. In this case, the cover 6 protects against flushing water being sprayed out of a housing which is formed by the cover 6 together with the trough 5. The contaminated flushing water is likewise let or pumped out of the trough 5.

One advantage is that the brush roller 4 is cleaned within the printing press 1 during continuous printing operation of the latter. Neither removal of the cleaning apparatus 3 out of the printing press 1 nor interruption of printing operation is necessary.

The invention claimed is:

1. A method for operating a cleaning apparatus of a printing press, the method comprising the following steps:

providing a cylinder of the printing press;

providing the cleaning apparatus with a trough and a brush disposed in the trough;

in a first step, cleaning the cylinder of the printing press with the cleaning apparatus while the brush bears against the cylinder;

in a second step, moving the brush away from the cylinder and changing a level of a liquid in the trough relative to the brush, resulting in the liquid being brought into contact with the brush; and in a third step, cleaning the brush with the liquid in the trough.

2. The method according to claim 1, which further comprises moving the brush and the trough away from the cylinder together in the second step.

3. The method according to claim 1, which further comprises raising the level of the liquid in the second step by conveying the liquid into the trough.

4. The method according to claim 1, which further comprises closing a cover of the trough after the first step.

5. The method according to claim 1, wherein the brush is a brush roller.

6. The method according to claim 5, which further comprises rotating the brush roller in a stepped manner or more slowly during its cleaning in the third step than during the cleaning of the cylinder in the first step.

7. The method according to claim 1, which further comprises loading the liquid with energy by an ultrasonic generator in the third step.

8. The method according to claim 1, which further comprises moving the trough away from the cylinder in the second step.

9. The method according to claim 1, which further comprises carrying out the step of changing the level of the liquid in the trough relative to the brush in the second step, by raising the level of the liquid.

10. A printing press, comprising:

a cleaning apparatus for carrying out the method according to claim 1.

* * * * *